US005086708A

United States Patent [19]

McKeown, Jr. et al.

[11] Patent Number: 5,086,708

[45] Date of Patent: Feb. 11, 1992

[54] RAILCAR TRUCK BOLSTER WITH IMMOBILIZED FRICTION SHOES

[75] Inventors: Franklin S. McKeown, Jr., St. Louis, Mo.; Charles Moehling, Arlington Heights; Charles P. Spencer, Staunton, both of Ill.

[73] Assignee: Amsted Industries Incorporated, Chicago, Ill.

[21] Appl. No.: 607,828

[22] Filed: Nov. 1, 1990

[51] Int. Cl.[5] ..... B61F 5/40

[52] U.S. Cl. ..... 105/207; 105/198.2

[58] Field of Search ..... 105/198.5, 207, 198.2, 105/193

[56] References Cited

U.S. PATENT DOCUMENTS

| | | | |
|---|---|---|---|
| 2,545,591 | 3/1951 | Shaw | 105/198.2 |
| 2,615,403 | 10/1952 | Orr et al. . | |
| 2,672,102 | 3/1954 | Davidson | 105/198.5 |
| 2,720,172 | 10/1955 | Baselt | 105/198.5 |
| 2,871,801 | 2/1959 | Couch | 105/198.5 |
| 3,005,418 | 10/1961 | Couch | 105/198.5 |
| 3,805,707 | 4/1974 | Neumann . | |
| 4,637,319 | 1/1987 | Moehling . | |
| 4,825,775 | 5/1989 | Stein et al. . | |

*Primary Examiner*—Margaret A. Focarino
*Assistant Examiner*—Joseph D. Pape
*Attorney, Agent, or Firm*—Edward J. Brosius; F. S. Gregorczyk

[57] ABSTRACT

Friction shoes are immobilized within the pockets of a railcar truck bolster by threaded pins that are inserted through apertures in the pocket walls and friction shoes and guided into the inboard pocket wall apertures by a concentric tapered surface within the pockets on the inboard pocket walls.

4 Claims, 3 Drawing Sheets

RAILCAR TRUCK BOLSTER WITH IMMOBILIZED FRICTION SHOES

BACKGROUND OF THE INVENTION

This invention relates to railcar trucks and more particularly involves method and structure for assembling and disassembling friction shoes fitted and spring loaded within pockets such as the improved assembly of a truck bolster with friction shoes in the bolster pockets, and improved bolster and shoe components therefore.

A typical railcar truck comprises wheelsets mounted on two axles which support side frames at each side of the railcar and a transverse bolster extending between the side frames with the ends thereof supported between two vertical columns on load springs carried by each side frame. Usually a truck is located under each end of a railcar and the car itself is pivotally supported upon a centerplate centrally positioned on each bolster. Thus the weight of the railcar will cause the ends of the bolsters to move vertically on the load springs while confined between the vertical columns.

To provide proper damping for the suspension system, friction shoes are spring biased in pockets to frictionally retard vertical movement between the bolster and the side frame columns. Although it is possible to locate such pockets in the side frame columns, it is more common to locate the pockets in the bolster. The friction shoes have vertically disposed friction faces which contact friction plates secured to the opposite truck component. In certain types of such friction shoes there is a shoe slope surface, generally opposite the friction face, which declines from a top portion of the friction shoe to a bottom portion thereof and away from the friction face and which slope surface engages a sloped surface on the inside of the pocket. The latter type shoe also has a bottom opening or hole through which a control spring extends to the top portion of the shoe. The control spring urges the friction shoe against the pocket sloped surface and upwardly through the pocket, while the slope also guides the shoe outwardly of the pocket against the opposite truck member such as the friction plate on the frame vertical column.

THE PRIOR ART

When a truck is assembled the shoes, and control springs, are normally first placed in bolster pockets at the assembly site and thereafter the bolster ends are inserted through each respective side frame. The load springs are then positioned in each side frame and the bolster ends lowered thereon. Normally it is necessary to temporarily compress and secure each of the shoes fully within the respective bolster pockets so that the bolster ends may be inserted between the side frame friction plates. In the past this has been done by inserting pins into apertures in the internal pocket walls through aligned apertures in the shoes. Such a technique is taught in U.S. Pat. No. 2,615,403 to Orr et al. Such pins are, with difficulty, manually manipulated through the apertures in the pocket walls, which apertures ordinarily are provided for both pin reception and shoe inspection purposes. The pins must be similarly removed after the truck is assembled. Furthermore, it is difficult to precisely align the shoe and pocket apertures to enable pin reinsertion if the truck must be disassembled for maintenance and the like.

It has been proposed that the shoes could be compressed and held in place within bolster pockets by a full exterior encirclement fastened about the outer periphery of the bolster and shoes and which encirclement could be easily released. However such an encirclement interferes with proper bolster side wall placement between the side frame vertical friction plates. Moreover such a full exterior encirclement, when released, is immediately gripped between the friction shoe friction face and the side frame friction plates where it will interfere with proper movement of the parts. An acceptable partial encirclement, passing through the shoes and bolster pockets, is disclosed in U.S. Pat. No. 4,825,775 to Stein et al. However, a shortcoming of both full and partial encirclements is that once removed they cannot be reimplaced for truck disassembly. Furthermore, such structures are appropriate only for bolster applications.

Accordingly, a preassembled pocket with pre-compressed friction shoe held in place with immobilizing means that is easily removed and reimplaced would be of benefit to the railroad industry. Such pre-assembly could be most expeditiously undertaken at a truck component manufacturing facility rather than at a truck or railcar assembly point, yet the immobilizing means could be both removed or reimplaced at any truck assembly or maintenance facility.

SUMMARY OF THE INVENTION

Accordingly, it is a primary object of the present invention to provide a method for assembling a railcar truck friction shoe held compressed within a pocket by immobilizing means that is easily both removed and replaced.

It is another object of the present invention to provide a railcar truck friction shoe which is held compressed within a pocket by immobilizing means that is easily both removed and replaced.

It is still another object of the present invention to provide a method for assembling a railcar truck bolster with friction shoes held compressed within bolster pockets by immobilizing means that are easily implaced, removed and replaced after being removed from the shoes and pockets.

It is yet another object of the present invention to provide a railcar truck bolster preassembled with friction shoes which are held compressed within the bolster pockets by immobilizing means that are easily implaced, removed and replaced after being removed from the shoes and pockets.

A further object of the present invention is to provide an improved railcar truck pocket structure having guide means within the pocket to direct an immobilizing means into a receiving aperture in an inboard pocket wall.

Still another object of the present invention is to provide an improved railcar friction shoe having notches to cooperate with pocket wall guide means for directing an immobilizing means into a receiving aperture in an inboard pocket wall.

In brief the present invention comprises the application of an immobilizing means through friction shoe and pocket wall apertures wherein the pocket wall aperture that last receives the immobilizing means includes a guide means adjacent thereto to direct the immobilizing means to that aperture. Preferably the immobilizing means is a threaded and pointed shaft; and the friction shoe includes notches cooperating with the pocket wall guide means.

DESCRIPTION OF THE DRAWINGS

Further objects and advantages of the present invention will become apparent from the following detailed description of a preferred embodiment in conjunction with the drawings wherein.

DETAILED DESCRIPTION OF THE INVENTION

Figure 1:
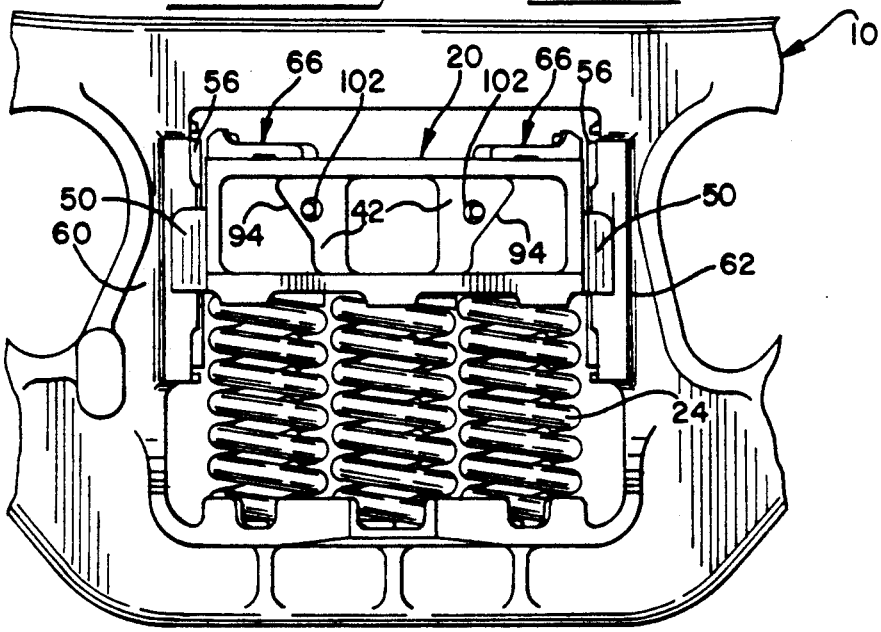
FIG. 1 PRIOR ART
FIG. 1 is a partial elevation view of a prior art assembled railcar truck with a pocket bearing bolster end supported in a side frame and pins holding friction shoes compressed within the pockets.

Existing railcar structures employ trucks comprising side frames generally 10 which are supported above bearings (not shown) resting on axles and wheels (also no shown). A transverse bolster generally 20 having open ends 22 extends between two side frames 10 whereupon the bolster is supported on load springs 24 seated in the side frames 10. The bolster is usually an essentially hollow member of cast steel having a top wall 28, bottom wall 30 and two opposite side walls 32, 34. Extending inward from each side wall near each bolster end 22 there are pockets generally 36 formed by spaced inboard and outboard walls 40, 42 (respecting the bolster ends 22) which extend to the bottom wall 30 from opposite openings in the side walls, 32, 34 and adjacent areas of the too wall 28. Each pocket 36 also includes inner wall 44 interconnecting the inboard and outboard walls 40, 42. The pockets 36 and particularly the walls 40, 42 are contoured to slidingly receive a particular shaped friction shoe such as shoe 66 hereinafter described in detail. Vertical gibs 50, 52 are formed in each of the side walls 32, 34 adjacent of the pocket openings therein.

When assembled with the side frames 10, the bolster ends 22 are urged upward by the load springs 24 and are moveable vertically between closely spaced friction plates 56 that are disposed on vertical columns 60, 62 in the side frames, with the gibs 50, 52 located at the outward and inward edges of the friction plates so as to prevent separation of the bolster 20 from the side frame 10. The friction shoes generally 66 are reciprocally mounted and compressed on control springs 70 within the pockets 36 so as to be urged outwardly of the pockets and against the friction plates 56.

Figure 5:
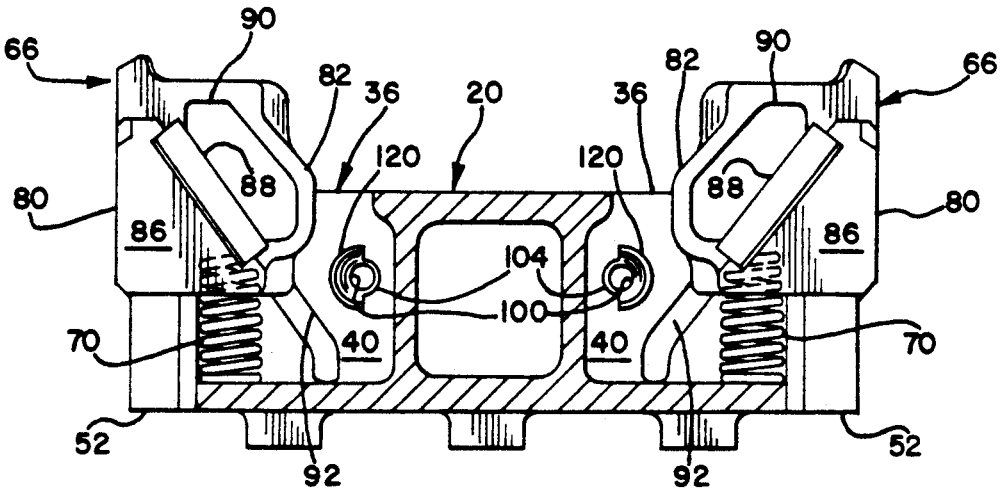
FIG. 5 is a sectional end view of a preferred bolster of the present invention showing the interior of the pockets with friction shoes partially inserted therein.
Figure 6:
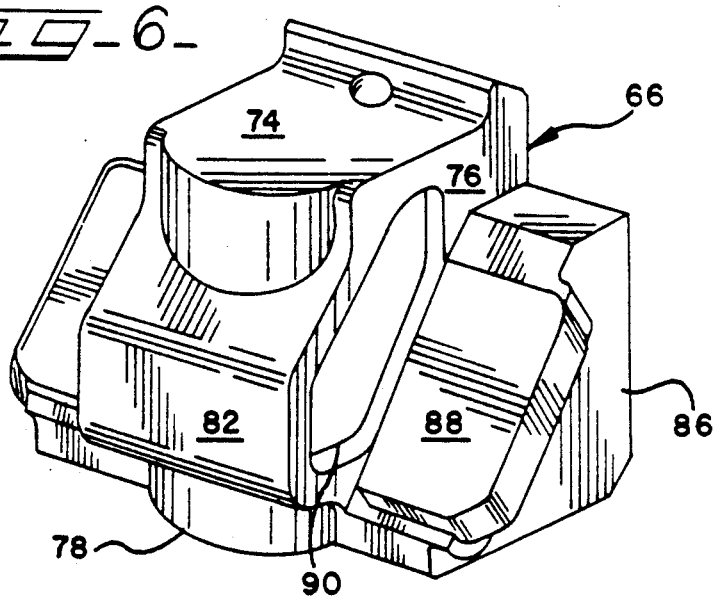
FIG. 6 is a perspective view of a friction shoe.

Each friction shoe 66, as shown in FIG. 6, comprises a hollow body to receive the spring 70 having top portion 74, side portions 76, a bottom foot 78, a vertical friction face 80, and a web B2 opposite the friction face. The shoe 66 is placed in its respective pocket with the friction face 80 disposed outwardly to engage a friction plate 56 on the side frame 10. As may be seen in FIG. 5, the respective control spring 70 extends upwardly through a hole in the foot 78 of a shoe, from a spring seat 84 on the bolster bottom wall 30 within pockets 36 and against the underside of the shoe too portion so as to urge the shoe out of the pocket.

The particular friction shoe 66 illustrated in FIG. 5 also has side wings 86 with sloped surfaces 88 extending essentially between the levels of the top portion 74 and foot 78 and declining away from the friction face 80, and there are slots 90 in each side portion 76 that are generally parallel to the sloped surfaces 88. The sloped surfaces 88 of shoe 66 are positioned inwardly of the pockets 36 so as to engage mating inboard and outboard bolster slope walls 92, 94 formed in the respective pocket internal walls 40, 42 so that the shoes are directed against the friction plates 56.

Figure 3:
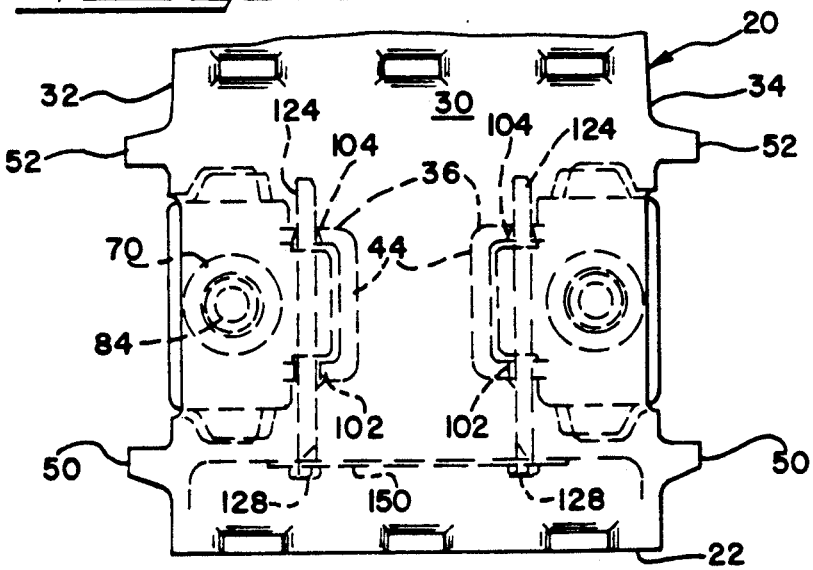
FIG. 3 is a bottom plan view of the bolster of FIG. 2 with shoe, pocket walls and immobilizing means shown in phantom lines.
Figure 4:
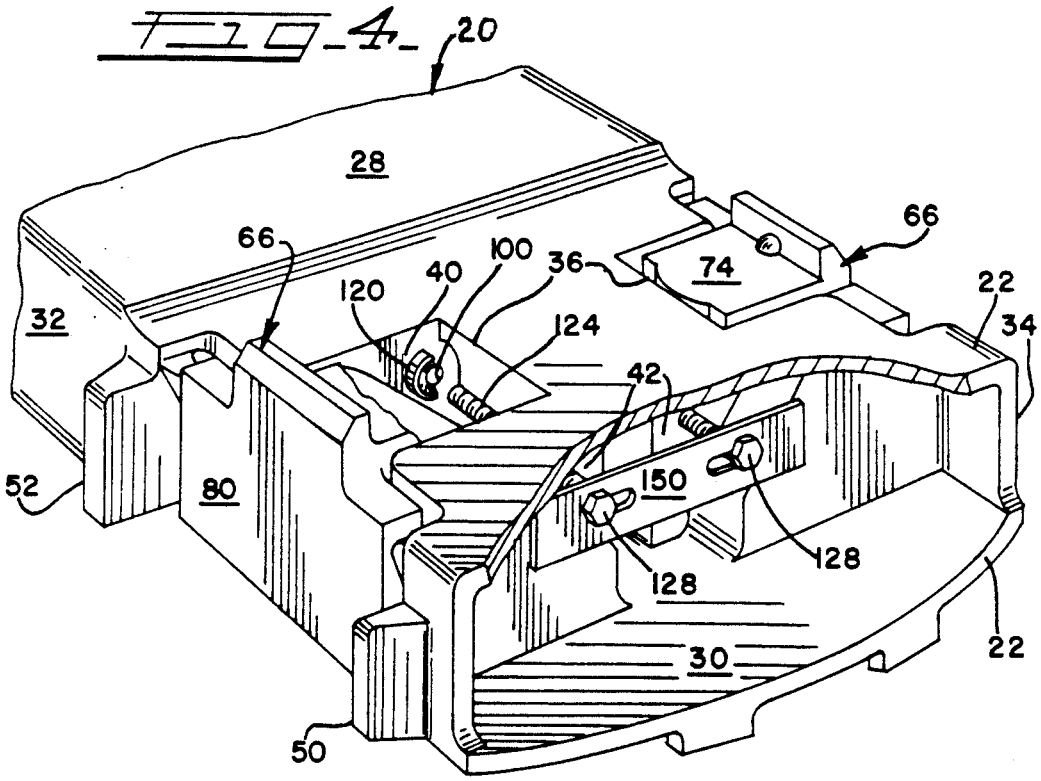
FIG. 4 is an isometric view of the bolster of FIG. 2, with portions broken away for clarity, showing two friction shoes and immobilizing means preassembled in accordance with the present invention.

As may be seen in FIGS. 3, 4 and 5 apertures 100, 102 are located in the respective inboard and outboard walls 40, 42 of pocket 36 so as to be aligned with vertical portions of slots 90 in the shoe 66 when the latter is compressed against its control spring 70. According to the prior art, as shown in FIG. 1, the shoes could be temporarily held in the compressed attitude by inserting smooth pins through the apertures 100, 102 and shoe slots 90.

The present invention provides a method and structure for immobilizing the friction shoes 66 within bolster pockets 36 and holding the shoes compressed and immobilized therein for an indefinite period. The method and structure hereafter described have an advantage of being easily repeated and replaced on a given shoe and bolster pocket and therefore have application in both preassembling a bolster with friction shoes inserted therein before being mounted in truck side frames and also for reimmobilizing the shoes within bolster pockets when it is necessary to perform maintenance thereon.

This invention is accomplished by providing the aforementioned apertures 100, 102 in the form of circular holes in the respective outboard and inboard pocket walls 40, 42 and forming a guiding means such as an inward taper or conical countersink 104 on the interior pocket surface of the inboard wall 40 concentric to the aperture 100. It is to be understood that the taper 104 assists in guiding and directing a pin or the like into the aperture 100. Preferably the taper 104 extends inwardly of the pocket on a projecting semiencircling boss 120, as seen in FIGS. 4 and 5, located toward a bolster side wall 32, 34 outward of the aperture 100 which is the direction that a shoe 66 will be urged by spring 70 and sloped surfaces 92, 94.

Thus by first compressing a friction shoe 66 against its control spring 70 into a pocket 36, and thereby generally aligning the slots 90 in the shoe 66 with pocket apertures 100, 102, the shoe may be immobilized against outward movement by inserting therethrough an immobilizing means, such as a pin generally 124. The guiding means countersink 104 assists in directing the pin 124 into aperture 100 should the pin be angled vertically or should shoe slots 90 be slightly out of alignment and cause the pin 124 to be angled outwardly. The guiding means is further enhanced if it includes the aforementioned semi-encircling boss 120.

Preferably the pin 124 is pointed at an insertable end 126 to further facilitate aiming into the aperture 100.

Additionally the pin 124 should be provided with an enlarged head 128 at the end opposite point 126 to facilitate manipulation of the pin and also the extraction thereof.

In the most preferred embodiment of the immobilizing means the pin 124 has a helical surface, such as a coarse thread 136, along its length and the enlarged head 128 is configured, as by the hexagonal head illustrated, to accept a wrench or other tool by which the pin 124 may be twisted.

It will thus be understood that by pushing pin 124 through the aperture 102 in the outboard pocket wall 42 and through slots 90 in shoe 66 and against the tapered countersink surface 104, the pin will lever the shoe slots 90 into alignment with both apertures 100, 102. Further pushing will result in the pin 124 extending through aperture 100. By also twisting the pin 124 in one direction (usually clockwise) the action of the helical surface of thread 136 against a rim of aperture 100 will cause the pin to be drawn inward. Furthermore the helical surface will tend to prevent withdrawal of the pin 124 from aperture 100 unless it is twisted in a reverse direction.

The latter feature is further enhanced by the tapered surface 104 of aperture 100 so as to present a smaller diameter hole and pronounced sharp angled rim on the inboard side of inboard pocket wall 40.

The threaded pin 124 may also be readily extracted by reverse twisting in which case the action of the thread 136 against edges of the shoe slots 90 and the aperture 102 will cause the pin to move in an outboard direction.

Figure 7:
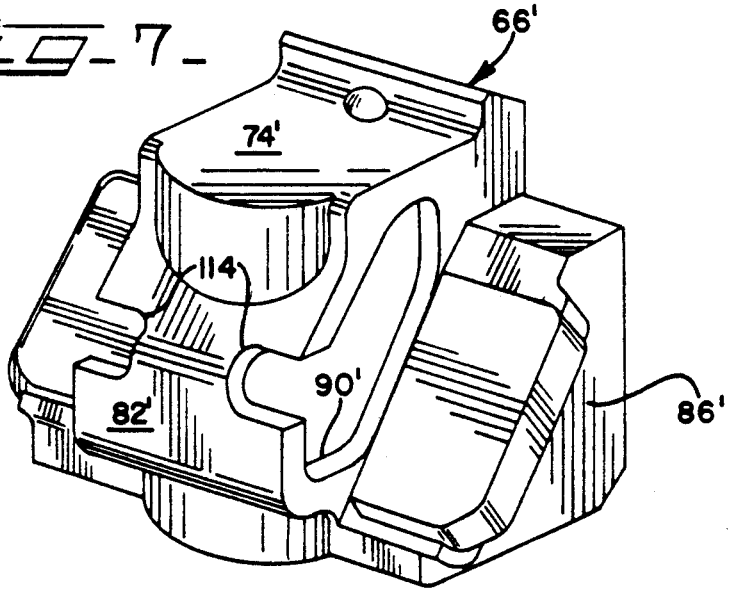
FIG. 7 is a perspective view of a preferred friction shoe.
Figure 8:
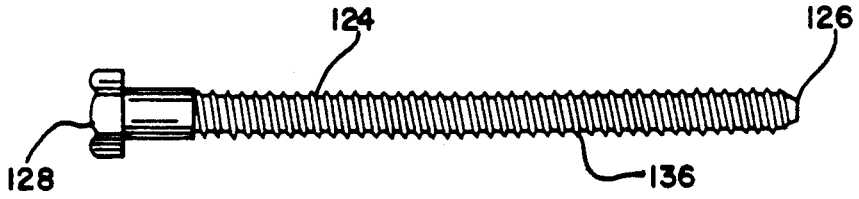
FIG. 8 is a side view of a preferred immobilizing pin used in the assembly of FIGS. 2, 3 and 4.

It should be noted in FIG. 7 that a preferred friction shoe 66' includes notches 114 in web 82' to pass over the boss 120. Since a shoe 66' may be placed in either the left or right side pocket of a bolster but the boss 120 is always to be located on the inboard pocket wall 40, it is necessary to make symmetrical inwardly extending notches 114 from both sides of the shoe.

Figure 2:
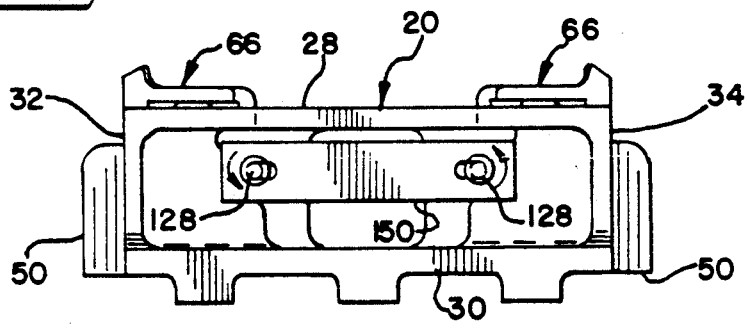
FIG. 2 is a detail end view of a bolster end with preassembled shoes in accordance with an embodiment of the present invention.

As shown in FIGS. 1, 2 and 4, it is usual that the ends 22 of a bolster 20 are open. This permits access for the aforedescribed inserting and extracting of pins 124. It is also to be noted in FIGS. 2, 3 and 4 that a warning and instruction strap 150 is preferably impaled by pins 124 outboard of the pockets 36. There are a number of advantages to the placement of strap 150. Foremost it is more visible than the heads 128 of the pins 124 and serves to warn that the pins must be removed after the bolster 20 is placed in side frames 10. To further enhance this function the strap 150 may be vibrantly colored and have instructional information displayed thereon. Secondly, the strap 150 may be shaped or located to stand away from apertures 102 and hold the pin heads 128 spaced outboard of the outboard pocket walls 42 whereby they be easily accessible to an appropriate tool such as a socket wrench. This may be important where the pocket wall structure, as shown, includes angles closely adjacent the apertures 102 which would otherwise interfere with placement of the tool on the pin head 128. Further where the strap 150 is shaped or located to hold the pin head 128 outward of the aperture 102 the pin 124 must itself by sufficiently long to extend through the inboard aperture 100 and the strap will begin to deform only after the pin thread 136 engages the rim of aperture 100 thereby indicating the shoe 66 is safely immobilized.

The foregoing detailed description has been given for clearness of understanding and to provide a complete description of a preferred embodiment of the invention. Various modifications may be made without departing from the spirit and scope of the invention which is defined int he following claims.

What is claimed is:

1. In a combination of a friction shoe and a railcar truck pocket for spring biased reception of the shoe wherein opposite pocket walls and a portion of the shoe each have apertures that may be aligned to receive an immobilizing means when the shoe is compressed within the pocket, the improvement comprising:

guiding means within said pocket concentric with one of said apertures on a pocket wall directing said immobilizing means into said one aperture, said immobilizing means comprising a threaded pin having one pointed end and an enlarged opposite end, said pointed end being extended through said one aperture and said guiding means, and wherein said friction shoe is immobilized in a pocket at an end of a truck bolster, and further including a spacer strap between said enlarged opposite end of said pin and an outer surface of an outboard pocket wall to space said enlarged end from said outboard pocket wall.

2. The combination of claim 1 wherein said guiding means includes a tapered countersink surface surrounding said one aperture.

3. The combination of claim 2 wherein said one aperture is circular; said guiding means is a boss having an arcuate surface adjacent and substantially concentric to said one aperture, said boss extending from an inboard pocket wall into said pocket.

4. The combination of claim 1 wherein said immobilizing means is a pin having a pointed end, said pointed end being extended through said one aperture and said guiding means.

* * * * *